US006465954B2

(12) United States Patent
Kerslick et al.

(10) Patent No.: US 6,465,954 B2
(45) Date of Patent: Oct. 15, 2002

(54) CATHODE STRUCTURE WITH GETTER MATERIAL AND DIAMOND FILM, AND METHODS OF MANUFACTURE THEREOF

(75) Inventors: Graham Steven Kerslick, Minneapolis; Victor Ivan Chornenky, Minnetonka, both of MN (US)

(73) Assignee: Medtronic AVE, Inc., Santa Rosa, CA (US)

( * ) Notice: Subject to any disclaimer, the term of this patent is extended or adjusted under 35 U.S.C. 154(b) by 0 days.

(21) Appl. No.: 09/748,437

(22) Filed: Dec. 27, 2000

(65) Prior Publication Data

US 2001/0015604 A1 Aug. 23, 2001

Related U.S. Application Data

(63) Continuation of application No. 09/138,449, filed on Aug. 21, 1998, now abandoned.

(51) Int. Cl.[7] ..... H01J 17/24

(52) U.S. Cl. ..... 313/558; 313/553; 378/119

(58) Field of Search ..... 313/560, 553, 313/309, 310, 558, 562, 481; 378/64, 65, 119, 121, 122; 417/48

(56) References Cited

U.S. PATENT DOCUMENTS 5,854,822 A * 12/1998 Chornenky et al. ..... 378/122
6,108,402 A * 8/2000 Chornenky ..... 378/119

* cited by examiner

*Primary Examiner*—Vip Patel
*Assistant Examiner*—Joseph Williams
(74) *Attorney, Agent, or Firm*—Catherine C. Maresh

(57) ABSTRACT

A cathode structure comprising a getter material provided with a diamond film. The getter material may include zirconium, vanadium and iron. Cathode structures may have a substantially rounded configuration including a substantially straight portion. Other cathode structures may have a substantially flat portion, with the diamond film covering essentially the entire flat surface. Methods of manufacturing cathode structures may include conditioning the cathode structure by applying a voltage.

16 Claims, 5 Drawing Sheets

CATHODE STRUCTURE WITH GETTER MATERIAL AND DIAMOND FILM, AND METHODS OF MANUFACTURE THEREOF

This application is a continuation of Ser. No. 09/138,449 filed Aug. 21, 1998 now abandoned.

FIELD OF THE INVENTION

The present invention is directed to a cathode structure and methods of manufacture, and more particularly to a cathode structure including a getter material and a diamond film and methods of manufacture thereof.

BACKGROUND OF THE INVENTION

In the electronic arts, cathodes are required for many diverse applications. A cathode is an electrode by which electrons enter a system, such as an electrolytic cell or electron tube. Cathodes are also employed in X-ray devices, flat panel-display systems, microwave sources, radar, communications, high power fast switches, electron beam processing of materials, high gradient accelerators, and many other applications.

Cathodes are generally divided into four types: thermionic cathodes, laser driven photo-cathodes, field emission cathodes, and exploding or plasma field emission cathodes. Field emission cathodes may for example be used in vacuum applications.

Vacuum field emission cathodes produce an electron beam by Fowler-Nordheim quantum tunneling of electrons from near the Fermi level into the vacuum. A relatively large electric field is required compared to other cathode types. The large electrical field that is required can be obtained from enhancements of the applied field due to surface irregularities.

One example of a device that may employ a field emission cathode is a miniature X-ray device. One such X-ray device is discussed in the U.S. Patent application, Device for Delivering Localized X-ray Radiation to an Interior of a Body and Method for Manufacture, filed Feb. 21, 1997, U.S. Ser. No. 08/806,244, currently pending, which is incorporated herein by reference in its entirety. The X-ray device described in U.S. Ser. No. 08/806,244 is designed for use inside a body, and the cathode operates inside a vacuum chamber.

Flat panel displays also require small, effective cathodes in a vacuum environment, and field emission cathodes may be used for flat panel displays. It will be appreciated that there is a need for an effective vacuum field emission cathode that can be used in applications that are sensitive to space restraints.

SUMMARY OF THE INVENTION

Generally, the present invention provides a cathode structure, and a method for fabricating such a device. The cathode structure may be used for electron emission and includes a body comprising a getter material, and a diamond film on the body.

An embodiment of a cathode structure in accordance with the invention may include a substantially rounded portion and a substantially straight portion.

A method of manufacturing a cathode structure includes forming a body using a getter material, and forming a diamond film over the body.

An embodiment of a method in accordance with the invention may further include forming the body with a substantially rounded shape and conditioning the cathode structure.

BRIEF DESCRIPTION OF THE DRAWINGS

The invention may be more completely understood in consideration of the detailed description of various embodiments of the invention which follows in connection with the accompanying drawings, in which.

Figure 1A:
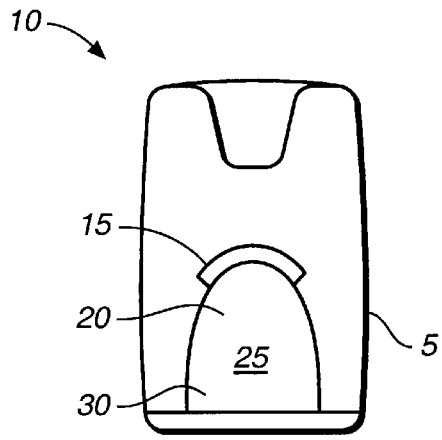
FIG. 1A schematically shows a cross section view of an x-ray device housing of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims.

DETAILED DESCRIPTION OF THE VARIOUS EMBODIMENTS

In embodiments in accordance with this invention, a cathode structure comprising a getter material with a diamond film serves as an electron emitter when a voltage differential is applied. This combination of elements may allow smaller electronic devices to be formed with a very simple design.

The present invention is applicable to a variety of devices, methods of fabrication, methods of use, systems and arrangements which include cathode structures for emitting electrons. For example, embodiments of the invention may be used in miniature X-ray devices. As another example, embodiments may be used in flat panel displays.

Cathodes that emit electrons by field, or cold, emission have a wide range of applications in the area of vacuum electronics. From structural considerations, field emission cathodes are much simpler than other electron sources, requiring simply an additional electrode, the anode, to complete the diode device. In contrast, thermionic cathodes require a heater to produce electrons. Photocathodes require a separate laser source and plasma field emission cathodes are inherently unstable sources.

In most advanced vacuum electronic applications such as X-ray tubes, flat panel displays for TVs and computers, microwave tubes for radar and communications equipment, and electron sources for particle accelerators, a getter is included within the device to maintain the stringent vacuum conditions required for operation. By combining the getter and the cathode into a single structure a significant space saving can be achieved. The particular geometry of this getter-cathode will be application dependent. In an X-ray tube a single diamond coated getter may be sufficient, while in flat panel applications a pixel type array of diamond emitters on a flat getter base may be utilized.

Figure 1B:
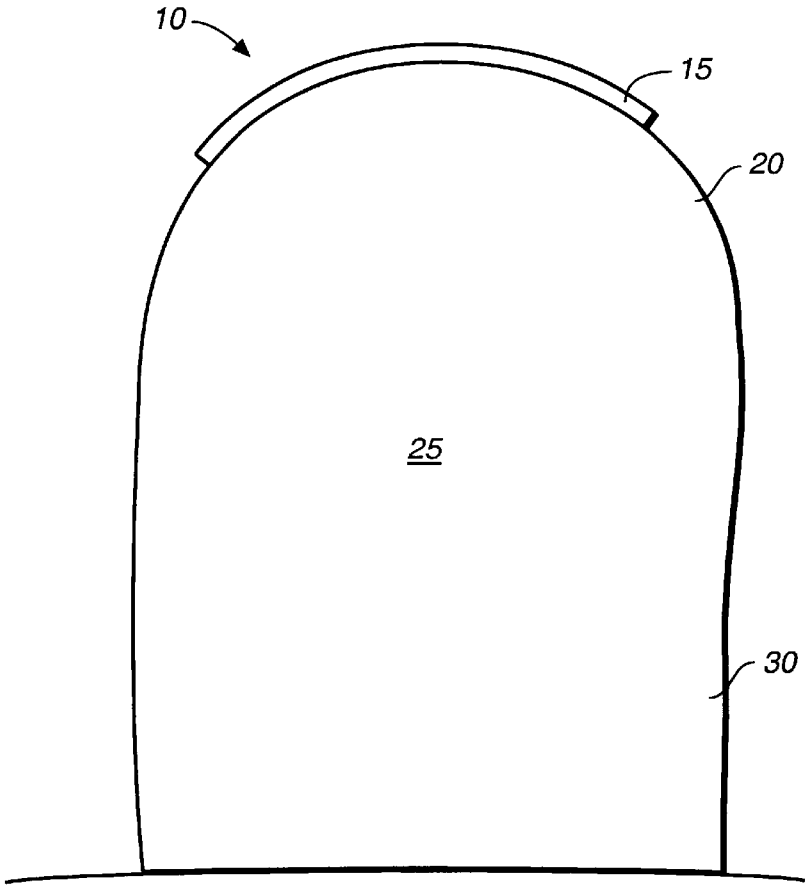
FIG. 1B schematically shows a cross-sectional view of a first embodiment of a cathode structure in accordance with the present invention.

FIG. 1 illustrates a first embodiment of a cathode structure 10. The cathode structure 10 includes a substantially rounded portion 20 and a substantially straight portion 30. The rounded portion 20 may be substantially hemispherical, and the straight portion 30 may be substantially cylindrical in one embodiment. The cathode structure 10 is provided with a diamond film 15. In this embodiment, the diamond film 15 is positioned on the rounded portion 20, but the position and configuration of the diamond film 15 may vary with different applications. The diamond film will not cover the entire exposed getter surface in a particular application, because at least a portion of the getter surface will be open in order to react with gas molecules.

The term diamond film or diamond coating, as used herein, contemplates a coating of carbon having diamond-like bonds which demonstrate negative electron affinity. It is also desirable for the diamond film to have sufficient conductivity to create a constant supply of electrons to the surface of the cathode structure. The film is not pure diamond, but rather it is amorphous diamond or diamond like carbon. The presence of some graphite bonds in the diamond film will contribute to conductivity. Thus a combination of a diamond film having both sp3 carbon bonds, to function as a cathode, and some sp2 carbon bonds, to facilitate conductivity, is particularly suited for use in such a system. Other elements may also be present in the film in small quantities. According to the invention, the diamond film will have the property that it can emit electrons at electrical fields greater than or equal to about 20 kV/millimeter. This required electric field is extremely low when compared to that required for metal emitters such as molybdenum or silicon, which require greater than 1,000 kV/millimeter.

Some exemplary measurements of the embodiment of the cathode structure will be given. In a miniature X-ray device application, a height of the cathode structure 10 may be approximately 1–2 mm, preferably about 1.5 mm. The width of the cathode structure 10 in such an application may range between approximately 0.25 to 1.5 mm, preferably about 0.5–1.0 mm, and most preferably about 0.75 mm. The diamond film in such an X-ray application may be on the order of a few microns thick, for example, approximately 2 microns thick. In other embodiments the measurements will be chosen in consideration of the particular application.

Figure 2A:
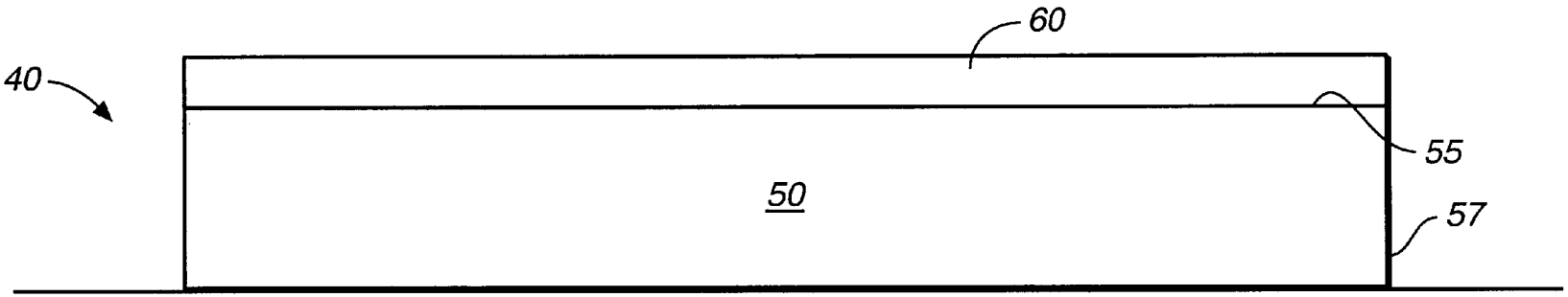
FIG. 2A schematically shows a side view of a second embodiment of a cathode structure in accordance with the present invention.

FIG. 2A illustrates another embodiment of a cathode structure 40 in accordance with the invention. The cathode structure 40 includes a body 50, having a substantially flat surface 55. On the substantially flat surface 50 a diamond film 60 is formed. In this embodiment, the diamond film 60 covers substantially the entire flat surface 55. The sides 57 of the getter 50 are still exposed to react with gas molecules. It is noted that in other embodiments and/or applications, the diamond film 60 may be formed so as to cover a smaller portion of the substantially flat surface 55.

Figure 2B:
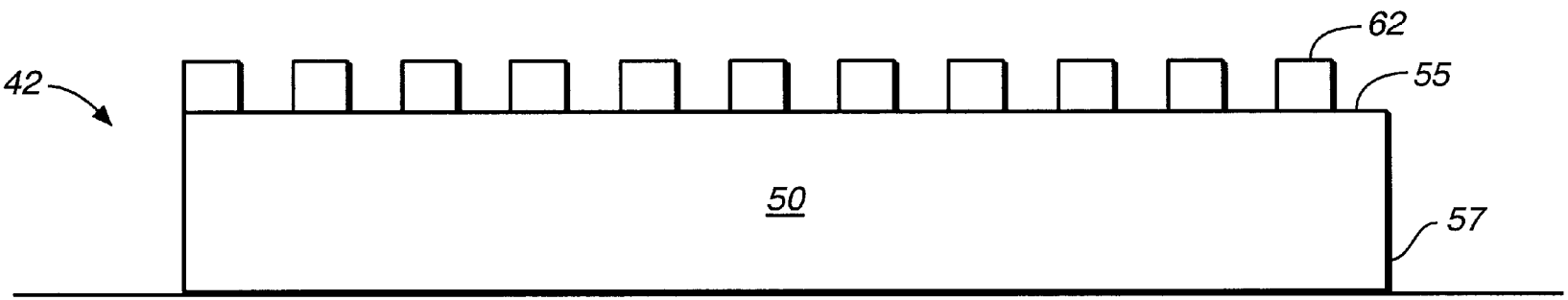
FIG. 2B schematically shows a side view of a third embodiment of a cathode structure in accordance with the present invention.

FIG. 2B illustrates an array of diamond coating areas 62 on the flat surface 55 of a cathode base 50 in another cathode structure 42 of the present invention. This type of cathode structure 42 may be utilized in a flat panel display environment. The diamond coating areas 62 may be many different shapes, such as cylindrical, cubical, rectangular or oval. Masking techniques are used to form the areas 62. In the flat panel display environment, the diamond coating may be on the order of submicrons thick, because the device itself may be on the order of a few microns in size.

As noted above, an X-ray cathode structure for use with catheters will typically have a size in the order of millimeters. As another example, in a flat panel display the cathode structure will probably be an array of emitting sites corresponding to pixels on the display, coated onto a getter-material base. The actual cathode may be sub-micron sized, but a substantial number of the cathodes will form the entire display panel. For microwave devices the cathode would probably be in the mm to cm size range.

Diamond coatings display attractive properties as field emitters, losing electrons easily as a field is applied. When a diamond film is provided on the cathode structure in an exemplary X-ray device embodiment, the electrical field required to produce about 8–10 kV of X-ray radiation may be about 10–20 kV/millimeter. In contrast, the required electrical field to produce a similar level of radiation from a metal emitter may be well over 1,000 kV/millimeter. A diamond-coated cathode structure may, for example, be used to achieve X-ray treatment radiation while producing significantly weaker electrical fields at the cathode structure.

In embodiments according to the present invention, a weaker electrical field may be required by the cathode structure, whereby the danger of malfunction such as electrical flashover between components in a system is reduced and less heat is generated. Furthermore, a wider array of conductors may be used for supplying power to the embodiments of the cathode structure.

In addition, the ability to lower the required electric field at the cathode structure may result in a less expensive manufacturing technique. Small irregularities on the surface of the cathode structure result in an increase in the magnitude of the electrical field for an applied voltage, thereby increasing the chance of electrical flashover. The weaker the required electrical field at the cathode structure, the more imperfections can be tolerated on the cathode surface without risking flashover. A goal for any electronic emission component is increased efficiency, for example, by reducing the required electric field. With a diamond film in accordance with the present invention, the required electric field is lower and does promote efficiency and is more consistent.

Using a getter base with a diamond coating, exemplary field emission current densities are approximately 0.1–5 milliamps per square millimeter at the cathode structure with electrical fields of 10–70 kV/mm.

The diamond film or diamond coating can be obtained by chemical vapor deposition, as is known in the art. Various materials may serve as an effective substrate for diamond film synthesis by chemical vapor deposition, such as tungsten, molybdenum, and tantalum. As described more fully below, the diamond film could also be fabricated by other methods, such as by laser ion deposition, making a wider range of materials available for the base of the cathode.

The body of the cathode structure comprises a getter material in order to aid in creating and maintaining a vacuum condition of high quality. It is noted that the body of the cathode structure may consist entirely of getter material, or it may comprise getter material together with other materials.

The body comprising getter material typically has an activation temperature, at which it will react with stray gas molecules in the vacuum. For example, at some point before the getter material is activated, it may be covered with a layer of oxidation that shields the getter material from the atmosphere at normal conditions. When the getter material is heated to an activation temperature in a vacuum, the oxidation layer diffuses into the interior of the getter material, revealing the active getter surface, which will react and bond with most molecules. Under vacuum conditions, the active getter material surface reacts with most stray gas molecules and bonds them to the getter, thereby improving the quality of the vacuum.

As an example, in one embodiment, the cathode structure is used in an X-ray device. After the cathode structure comprising getter material is disposed within a vacuum housing 10 and the housing is pumped out, the cathode structure is heated to the activation temperature. It is desirable that the getter material used has an activation temperature that is not so high that the X-ray device will be damaged when heated to the activation temperature.

The body of the cathode structure may comprise many different types of getter materials. The getter may include zirconium, aluminum, vanadium, iron, and/or titanium. In one embodiment, the getter materials may be composed of an alloy including vanadium, iron and zirconium. As an example, one successful choice for the getter material in the body of the cathode structure is a material produced by SAES Getters, S.p.A., via Gallarate 215, 20151 Milano, Italy and referred to as a SAES St-172. This getter material has a nominal composition including 82.0% zirconium, 14,7% vanadium and 3.3% iron. SAES St-172 has an activation temperature for full getter activation in the range of 400–500° C. for 10 minutes. The nominal 60% activation can be achieved at 300° C. for 30 minutes, and nominal 30% activation can be achieved at 250° C. for 30 minutes. The getter material in the cathode structure will be conductive enough to provide electrical connection between the diamond film and the body of the cathode structure.

Laser ion source deposition may be used to place the diamond film directly upon the cathode structure comprising a getter material. A traditional chemical vapor deposition process takes place at approximately 900° C. Therefore, a getter material in such a process would be activated and used up during the deposition process. However, the use of a laser ion source deposition process, which can be carried out at room temperature, allows a diamond film to be created on a body comprising getter material without activating the getter material. A laser ion source deposition process is described in U.S. Pat. No. 4,987,007, Wagal et al. U.S. Pat. No. 4,987,007, in its entirety is hereby incorporated by reference. The coating process that may be utilized by the present invention may be performed by the coating facilities at the University of Texas.

Figure 3:
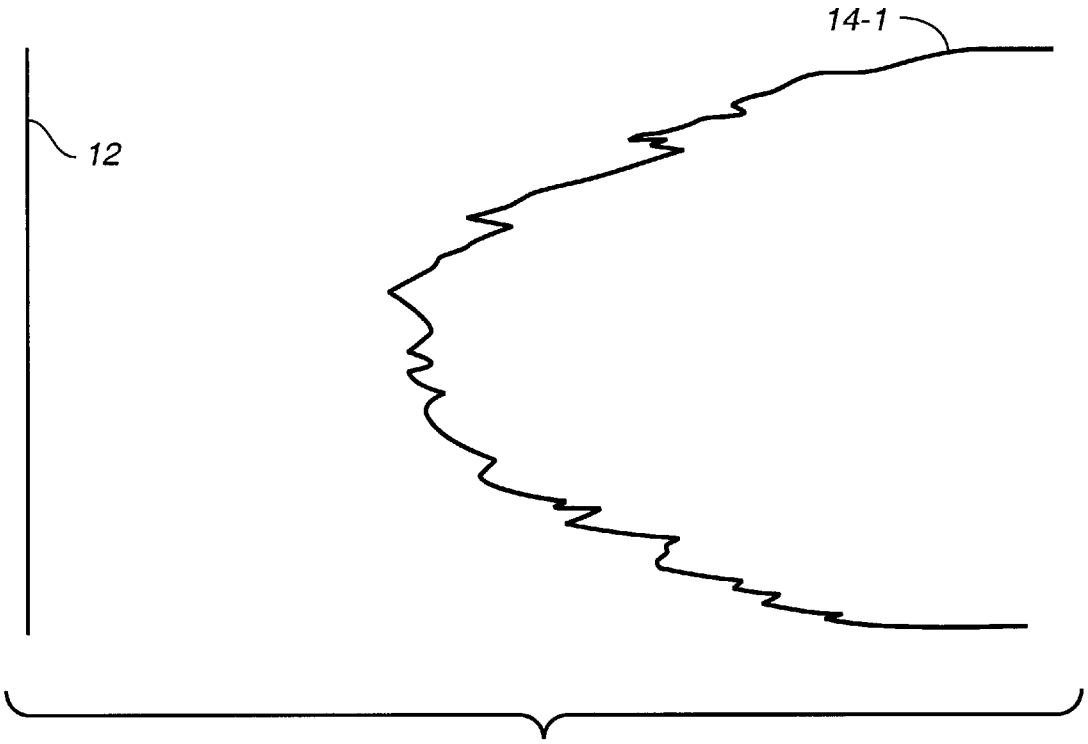
FIG. 3 is a side view of an embodiment of a cathode structure in accordance with the present invention.

In many embodiments of cathode structures according to the invention, the field emission properties of the cathode structure may be modified by a conditioning procedure. The conditioning may, for example include applying voltage to the cathode structure. Typically, the conditioning process takes place after the diamond film is deposited. Because the diamond film is relatively thin compared to the size of the getter, micro-protrusions on the getter surface will still be present after the diamond film is deposited. Slow application of increasing voltage gradually melts microprotrusions present on the cathode. The sharpest field-emitting microprotrusions may be thermally blunted following excessive electron emission brought on by the current conditioning. FIG. 3 shows a profile of a cathode surface 14-1 as formed with granular materials. When a voltage is applied to the cathode structure, an extremely large electrical field is formed at the sharp microprotrusions. The electron emissions is also very large at these locations, resulting in the overheating and melting of the microprotrusions. Before the microprotrusion melts, a very large current is generated, causing spikes in the emission curve. FIG. 5 shows a linear application of voltage to the anode and cathode. When the voltage of FIG. 5 is applied to the cathode structure, the current shown in FIG. 4 may result. There are many spikes in the current plot of FIG. 4.

Figure 4:
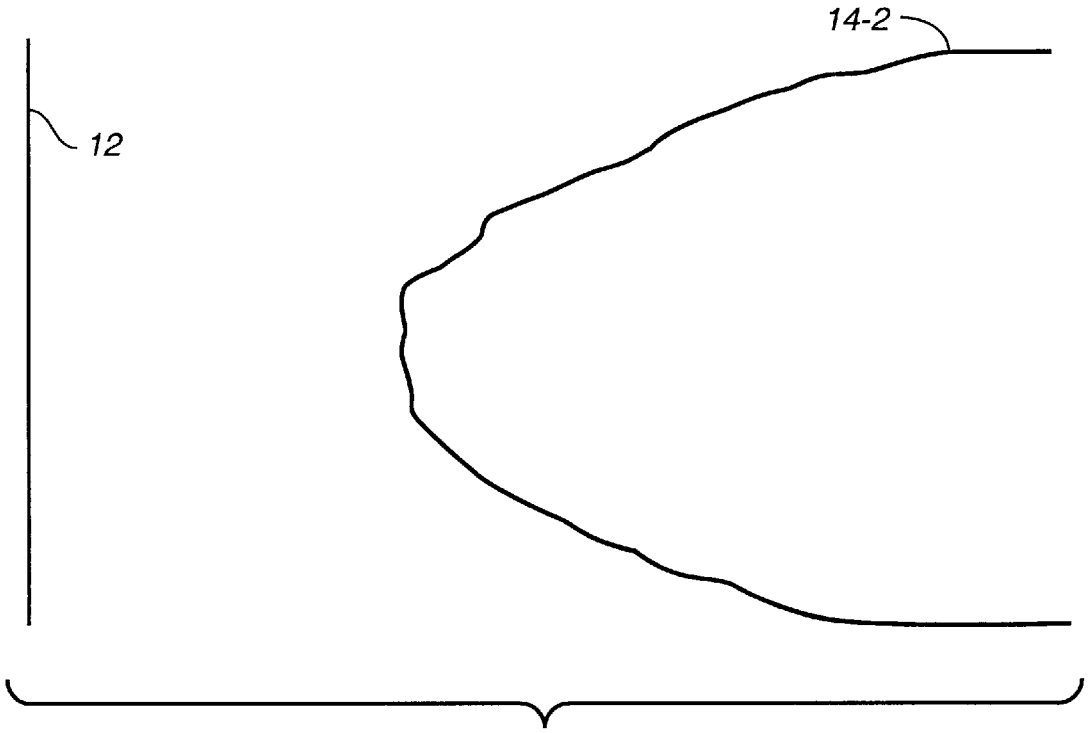
FIG. 4 is a side view of an embodiment of a cathode structure in accordance with the present invention.
Figure 5:
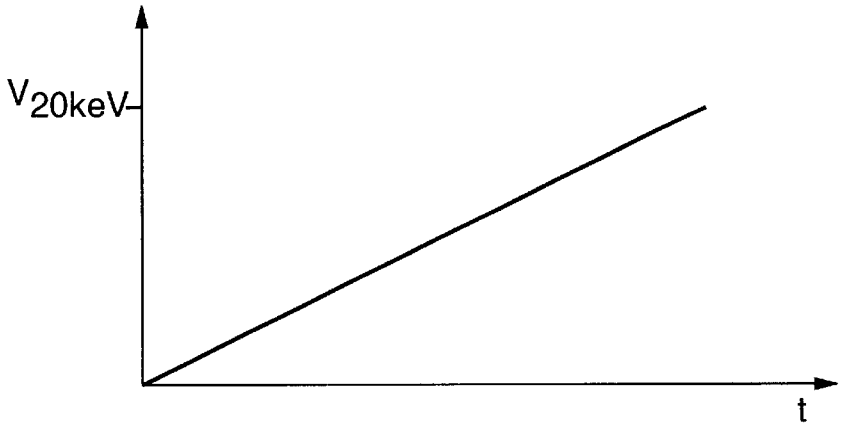
FIG. 5 is a plot of voltage applied versus time for the current plots shown in FIG. 6 and FIG. 7, for an embodiment of a cathode structure in accordance with the present invention.
Figure 6:
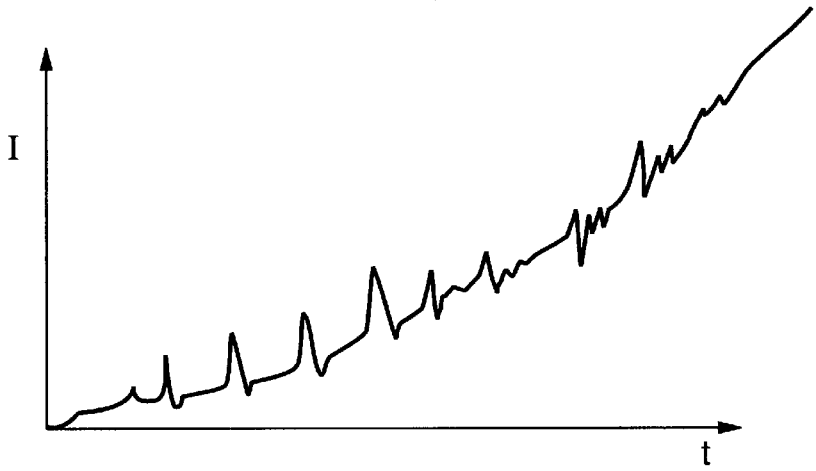
FIG. 6 is a plot of current versus time for the cathode structure of FIG. 3.

After conditioning the cathode 14-1, the cathode profile 14-2 shown in FIG. 4 may result. The sharp spikes are smoothed out. If the cathode profile 14-2 is intended for use at about 20 kV, then conditioning may be carried about from 0 kV to 25 kV to ensure a smooth rate of electron emission at the performance voltage.

Figure 7:
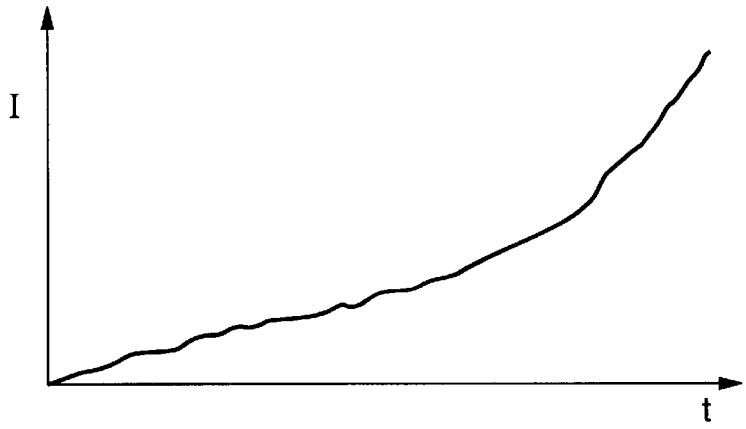
FIG. 7 is a plot of current versus time for the cathode structure of FIG. 4.

FIG. 7 shows a plot of current versus time for a cathode structure such as the one in FIG. 4, assuming the voltage application shown in FIG. 5. If the cathode will be operated to produce a current of 100 microamps, then it may be desirable to condition the cathode at currents of about 200 to 300 microamps.

It is preferred to balance the effect of the conditioning, which improves the reproducibility and stability of the current emitted, and the desired effect of the microprotrusions, which reduces the electrical field required for emission. The smoother cathode surface shown in FIG. 4 is one example of how this balance is achieved. In implementing this conditioning process, test cathodes may be used to determine the exact time and method of conditioning, and these parameters will be applied to other conditioning processes.

Figure 8:
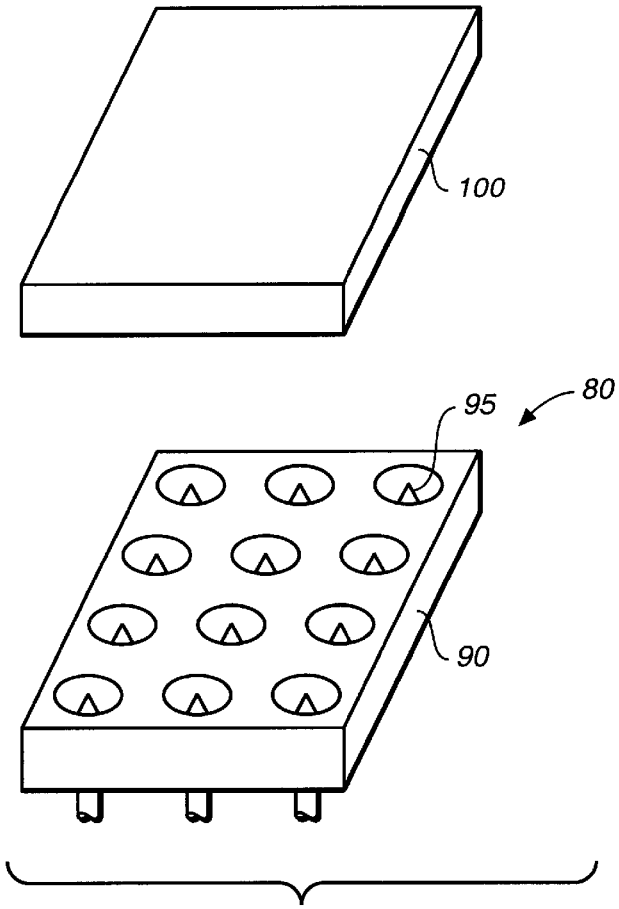
FIG. 8 is a side view of another embodiment of a cathode structure with a gate electrode.

Typically, a cathode is configured to be spaced apart from an anode. This configuration is called a diode. Now referring to FIG. 8, a triode configuration may also be used when there is enough space in the device to permit a third, or gate, electrode. The third electrode will be positioned near the cathode and allows independent control of anode-cathode current and anode-cathode voltage. Therefore, more varied performance characteristics may be elicited from a cathode when a gate electrode is used. One exemplary embodiment of a cathode structure 80 including a gate electrode 90 is shown in FIG. 8. A plurality of cathode structures 95 are positioned in spaces in the gate electrode 90. Electrons emitted from the cathode structures 95 are incident on the anode 100. Embodiments with this and similar types of gate electrode 90 may be particularly relevant to flat panel display applications where the anode 100 may be used as a screen. The cathode structures 95 may be flat or of many different configurations, depending on the particular application.

Figure 9:
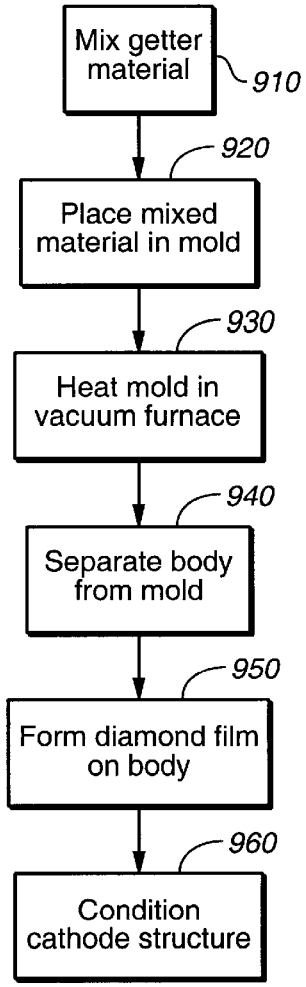
FIG. 9 is a flow chart of one embodiment of a manufacturing process in accordance with the present invention.

FIG. 9 shows an exemplary embodiment of a method for manufacturing a cathode structure. In step 910, mixing of the getter material is carried out. As explained above the getter material may, for example, comprise zirconium, vanadium and iron in certain proportions.

In step 920, the getter material is placed in a mold. The shape and configuration of the mold may be chosen in consideration of the particular application in which the cathode structure will be used. Well-known molds may be used with some embodiments of the invention. For example, the getter material may be placed in a mold including a substantially rounded configuration for one embodiment of a miniature X-ray device. The mold with the getter material is heated using a vacuum furnace in step 930. Conventional or well-known vacuum furnaces may, for example, be used in carrying out this step.

In step 940, the body of the cathode structure to be formed is separated from the mold using well-known techniques.

In step 950, a diamond film is formed on the body formed from getter material. The diamond film may be formed on varying portions of cathode structures in different applications of the invention. For example, the diamond film may be formed to cover substantially an entire flat surface of a cathode structure. It is also possible to attach the getter body to a cathode base before forming the diamond film in step 950.

Typically, the getter material has an activation temperature, and in such embodiments the diamond film formation may take place at a temperature below the activation temperature of the getter material. The formation may be carried out using, for example, laser ion source deposition techniques.

Step 960 includes conditioning of the cathode structure. As discussed above, conditioning may include supplying a voltage to the cathode structure, optionally in series with a resistor. In an exemplary embodiment, the applied voltage is increased in steps, allowing the "pre-breakdown" current to stabilize in between, and the increase in voltage is typically continued to include the intended operating voltage of the cathode structure.

The various embodiments described above are provided by way of illustration only and should not be construed to limit the invention. Those skilled in the art will readily recognize various modifications and changes which may be made to the present invention without strictly following the exemplary embodiments and applications illustrated and described herein, and without departing from the true spirit and scope of the present invention which is set forth in the following claims.

We claim:

1. A cathode structure for electron emission in a miniature X-ray device comprising a housing;

a cathode body within the housing, the cathode body comprising a getter material comprising approximately 82% zirconium, 14.7% vanadium and 3.3% iron;

a diamond film on a portion of the cathode body.

2. The cathode structure according to claim 1, wherein the body includes a substantially rounded portion.

3. The cathode structure according to claim 1, wherein the body includes a substantially rounded portion and a substantially straight portion.

4. The cathode structure according to claim 1, wherein an outer diameter of the cathode structure is less than or equal to approximately 1.0 millimeter.

5. The cathode structure according to claim 1, wherein an outer diameter of the cathode structure is less than or equal to approximately 0.75 millimeter.

6. The cathode structure according to claim 1, wherein an outer diameter of the cathode structure is less than or equal to approximately 0.5 millimeter.

7. A method of manufacturing a cathode structure for electron emission in a miniature X-ray device, the method comprising:

forming in a minitaure X-ray device a body using a getter material comprising approximately 82% zirconium, 14.7% vanadium and 3.3% iron; and forming a diamond film over at least part of a surface of the body.

8. The method according to claim 7, further comprising conditioning the cathode structure.

9. The method according to claim 8, wherein conditioning the cathode structure includes supplying a voltage to the cathode structure.

10. The method according to claim 9, wherein conditioning the cathode structure further includes increasing the voltage in steps.

11. The method according to claim 9, wherein the voltage is substantially equal to an operating voltage of the cathode structure.

12. The method according to claim 7, wherein the body is formed with a substantially rounded shape.

13. The method according to claim 7, wherein forming the diamond film includes using a laser ion source.

14. The method according to claim 7, further comprising activating the getter material.

15. The method according to claim 7, wherein the getter material has an activation temperature.

16. The method according to claim 15, wherein the diamond film is formed at a temperature less than the activation temperature.

* * * * *